US007695568B2

(12) United States Patent
Gaus

(10) Patent No.: US 7,695,568 B2
(45) Date of Patent: Apr. 13, 2010

(54) METHOD FOR ASSESSING AND GUARANTEEING THE THERMAL HYGIENE EFFICIENCY IN A MULTI-TANK DISHWASHER

(75) Inventor: Bruno Gaus, Offenburg (DE)

(73) Assignee: Meiko Maschinenbau GmbH & Co. KG, Offenburg (DE)

( * ) Notice: Subject to any disclaimer, the term of this patent is extended or adjusted under 35 U.S.C. 154(b) by 186 days.

(21) Appl. No.: 11/892,566

(22) Filed: Aug. 23, 2007

(65) Prior Publication Data

US 2008/0077281 A1 Mar. 27, 2008

Related U.S. Application Data

(60) Provisional application No. 60/854,427, filed on Oct. 26, 2006.

(30) Foreign Application Priority Data

Aug. 23, 2006 (DE) ..... 10 2006 039 434

(51) Int. Cl.
*B08B 7/04* (2006.01)

(52) U.S. Cl. ..... 134/18; 134/15; 134/25.2; 134/32

(58) Field of Classification Search ..... 134/18, 134/19, 25.2, 56 D
See application file for complete search history.

(56) References Cited

U.S. PATENT DOCUMENTS 3,915,180 A * 10/1975 Jacobs ..... 134/58 D
4,439,242 A * 3/1984 Hadden ..... 134/25.2

(Continued)

FOREIGN PATENT DOCUMENTS

DE 196 08 036 C1 7/1997

(Continued)

OTHER PUBLICATIONS

DIN prEN ISO 15883-1, "Washer-Disinfectors", Draft of Dec. 1999, CEN, Brussels, 1999.

(Continued)

*Primary Examiner*—Michael Kornakov
*Assistant Examiner*—Natasha Campbell
(74) *Attorney, Agent, or Firm*—Muncy, Geissler, Olds & Lowe, PLLC

(57) ABSTRACT

A method for assessing and guaranteeing the thermal hygiene efficiency in a multi-tank dishwasher in which there is at least one sensor that transmits a temperature inside at least one treatment zone to a machine control system, in particular to the control system of the multi-tank dishwasher, the method includes: detecting the temperature inside at least one of the treatment zones by the sensor; determining the heat input applied to the items to be cleaned in at least one of the treatment zones on the basis of the temperature determined; comparing the heat input in the at least one treatment zone with a predefined heat input; and, as a function of the result of the comparison of the heat input values, varying the transport speed of the items to be cleaned through the multi-tank dishwasher, or varying the temperature of at least one of the process parameters acting on the heat input values as a control variable in a control loop for at least one of the treatment zones.

25 Claims, 2 Drawing Sheets

U.S. PATENT DOCUMENTS

| | | | | |
|---|---|---|---|---|
| 4,561,904 | A * | 12/1985 | Eberhardt, Jr. | 134/18 |
| 5,820,691 | A * | 10/1998 | Hartman | 134/18 |
| 6,615,850 | B1 * | 9/2003 | Hornung | 134/57 R |
| 2002/0078979 | A1 * | 6/2002 | Aulbers et al. | 134/113 |

FOREIGN PATENT DOCUMENTS

| | | | |
|---|---|---|---|
| DE | 10 2004 056 052 | A1 | 6/2006 |
| EP | 1196650 | B1 | 10/2003 |

OTHER PUBLICATIONS

DIN 10510, "Food Hygiene- Commercial dishwashing with multitank-transportdishwashers-Hygiene requirements, procedure testing", Beuth Verlag GmbH, Berlin, Apr. 2001.

NSF/ANSI Mar. 2003, "Commercial Warewashing Equipment", Edition of Apr. 9, 2003, NSF International, Michigan, USA 2003.

* cited by examiner

METHOD FOR ASSESSING AND GUARANTEEING THE THERMAL HYGIENE EFFICIENCY IN A MULTI-TANK DISHWASHER

This nonprovisional application claims priority to German Patent Application No. DE 102006039434, which was filed in Germany on Aug. 23, 2006, and to U.S. Provisional Application No. 60/854,427, which was filed on Oct. 26, 2006, and which are both herein incorporated by reference.

BACKGROUND OF THE INVENTION

1. Field of the Invention

The present invention relates to a method for assessing and guaranteeing the thermal hygiene efficiency for items to be washed in a dishwasher during the cleaning process.

2. Description of the Background Art

For cleaning dishes in the commercial sector, multi-tank dishwashers are nowadays used in addition to single-chamber dishwashers. In these multi-tank dishwashers, the items to be cleaned are transported by a conveyor device through the various zones of the dishwasher. Multi-tank dishwashers generally comprise at least one washing zone, at least one final-rinse zone and, optionally, a drying zone. Multi-tank dishwashers, in which items to be cleaned pass through various treatment zones, are generally designed as conveyor-belt machines or basket transport machines. A common feature of both designs is that the items to be cleaned are transported continuously by the transporting means through the individual treatment zones. The individual treatment zones are usually designed as chambers that have openings in the transport direction of the conveyor device, through which openings the items to be cleaned are transported by means of the conveyor device.

At a start of operation of a multi-tank dishwasher, the washing water tank in the washing zone is filled with fresh water and heated to the preset washing tank temperature. Detergent is also added to the washing water. This applies analogously in cases where several washing zones are arranged in succession. The washing zone normally has a pump for circulating the washing water, which pump draws washing water from the washing water tank and sprays it onto the dishes via a spray system assigned to the washing zone, in order to remove the dirt adhering to the dishes. The washing water, together with the washed-off dirt, then flows back into the washing water tank. The washed-off dirt is filtered out of the washing water via a sieve system.

In the final-rinse zone, residues of detergent and of dirt located loosely on the dishes are washed off by means of hot fresh water which is sprayed via a corresponding spray system. In some design variants of multi-chamber dishwashers, the after-rinse water is collected in a pump-operated final-rinse tank after the first use and is once more sprayed by means of a pump and by means of a further spray system over the items that are to be cleaned. Chronologically, this process step takes place before the final rinse of the dishes with fresh water. The fresh water or final-rinse water is then returned in part to the washing water tank, in order to dilute the fragments of dirt located there in the washing water tank. The items to be cleaned are then transported into the optional downstream drying zone, in which the items to be cleaned are dried.

Process factors that have a critical influence on the cleaning result are the detergent concentration, the contact time of the items to be cleaned from the first contact with the washing water of the first washing zone until leaving the final-rinse zone, the mechanics of the spray systems and of the spray jets in the washing zones, and the temperatures in the individual washing zones. Methods are known for detecting the process parameters of detergent concentration, contact of the items to be cleaned with the washing water of the first washing zone until leaving the final-rinse zone, and the mechanics in the washing zone. Thus, the detergent concentration is usually detected via the conductance of the washing liquid. The contact time is obtained from the transport speed of the conveyor device, and the washing mechanics are determined via the pressure of the circulation pump and the design of the nozzles of the spray system in the respective washing zone. The temperature of the washing water in the individual treatment zones is detected by temperature sensors. As a result of the washing water cooling after it has left the spray nozzles of the spray system, the temperature that is reached on the surface of the items to be cleaned is not identical to the temperature of the washing water. However, for reducing microorganisms on the surface of the items to be cleaned, it is this temperature reached on the surface of the items to be cleaned in the individual treatment zones that is of critical influence, as also is the time for which these temperatures act on the items to be cleaned. The action of a certain temperature on the surface of the items to be cleaned over a certain period of time is or can be designated as heat equivalent.

The influence of temperature and time on microorganism reduction is one of the bases of regulations and standards that are intended to guarantee the cleaning efficiency of dishwashers. Based on trials carried out on multi-tank dishwashers, with the aim of establishing the process parameters at which reliable hygiene of the items to be cleaned is achieved, Germany adopted standard DIN 10510 C.3, which provides recommendations in respect of temperature, detergent concentration and duration between the first contact of the items to be cleaned with the washing liquid of the first washing zone until leaving the final-rinse zone, with which this multi-chamber dishwasher is to be operated in the individual treatment zones in order for customers to achieve the required microorganism reduction in operation. The basis of this standard is the microorganism reduction of specifically contaminated test specimens after the cleaning process by so-called swab tests. The test microorganism used in this test is E. faecium ATCC 6057.

The testing of hygiene safety of multi-tank dishwashers at the end-user is undertaken by means of swab tests and by determining the microorganism count in the washing water of the last wash tank. However, a disadvantage is the fact that the test of microorganism reduction according to this standard can be carried out at the customer's premises only at considerable expense. A further disadvantage of this standard is the fact that the same microorganism reduction could also be achieved, for example, with a shorter contact time, but at higher temperatures in the individual treatment zones. However, this standard does not permit this.

In the USA, the influence of temperature and time on microorganism reduction is described by the NSF3 standard method. The basis for this standard is the reduction of tuberculosis bacteria determined in trials involving the action of a temperature over time. The action of the temperature over time is designated as "heat equivalent". How many heat equivalents per second are reached at what temperature is set down in a table in this method. This tables defines a minimum temperature for the washing water of the washing zone and for the after-rinse zone, and dishwashers have to reach these minimum temperatures in order to achieve the microorganism reduction required by this standard. For dishwasher manufacturers, this means that these temperatures have to be preset in the control system of the relevant dishwasher at the time of manufacture and that these temperatures also have to be reached during operation of the multi-tank dishwasher by the customer. When testing a dishwasher according to his method, a temperature sensor is arranged on a plate. The plate is then placed in a predefined position in the transport device of the multi-tank dishwasher and is transported through the individual treatment zones of the multi-tank dishwasher. The temperatures are recorded during the cleaning process. From the temperature profile during the transport of the dishes through the multi-tank dishwasher, and from the abovementioned table, it is possible to determine the heat equivalents acting on the plate throughout the entire cleaning process. This test has to be carried out for three different plate positions in a dish-holding basket or a conveyor belt. To achieve the required microorganism reduction, this standard stipulates that at least 3600 heat equivalents have to be reached in each plate position. An advantage of this method is that the method can be carried out at relatively little expense at the customer's premises for checking that the multi-tank dishwasher is performing correctly in terms of the thermal hygiene. A further advantage is that the result is available immediately after the measurement, and a statement can therefore be made concerning the quality of the cleaning process.

However, a disadvantage in the operation of the dishwasher is the fact that, from the temperatures of the washing water of the individual treatment zones, conclusions have to be drawn concerning the heat equivalents acting on the dishes in the washing process, and not on the heat equivalents actually applied to the items to be washed.

In the field of cleaning and disinfecting appliances, prEN ISO 15883-1 describes a method which, in order to assess hygiene efficiency, also draws on the connection between the microorganism reduction and the temperature over time. This connection is designated as the A0 value and is likewise set down in table form or calculated from a mathematical formula. The A0 value is described in more detail in Annex A of this standard and is defined as the time equivalent in seconds at 80° C. at which a given disinfecting action is exerted, and corresponds analogously to the heat equivalents of the NSF3 standard, but on the basis of another test microorganism. The test microorganism used in this method is Enterococcus faecium. Here too, a minimum A0 value to be reached at any given location in the washing chamber of the cleaning/disinfecting appliance is stipulated. However, this method has not as yet been used for assessing commercial dishwashers in Europe.

The above-described methods and standards for guaranteeing the cleaning result in terms of the thermal hygiene in a multi-tank dishwasher all have the disadvantage that the process parameters are fixed in the operation of the dishwasher. This applies especially to the temperatures in the washing zone and final-rinse zone. If several programs or transport speeds can be selected, the multi-tank dishwasher has to be designed for the worst case. This means in general for the fastest transport speed. The fact that the operation of the multi-tank dishwasher is not based on a fixed method incorporated in the multi-tank dishwasher for the heat equivalents actually acting on the items to be cleaned, which method is connected to the control system of the multi-tank dishwasher and controls the washing process, results in the disadvantage that the multi tank dishwasher in terms of the heat equivalents cannot be optimally adapted to the actual washing process or washing program. A further disadvantage of the presently available prior art is that the heat equivalents actually transmitted to the items to be washed are not detected, and instead it is assumed that the required microorganism reduction is achieved at the process parameters stipulated according to the standard or method.

EP 1 196 650 B1 relates to a method for monitoring a washing process. An independent cableless monitoring device is mounted on a conveyor belt of an industrial dishwasher and is moved along with the belt. The measured data are recorded in a monitoring unit. With this device, the temperatures were able to be recorded at the individual washing zones and evaluated at a later time. The heat equivalents transmitted to the items to be cleaned could then be determined on the basis of the determined temperature values. The difference from the temperature recording according to the NSF3 standard method is that the temperature recording is wireless. However, like the test method according to the NSF3 standard, the device known from EP 1 196 650 B1 serves only to control the process temperatures and is not evaluated by the control system of the dishwasher and thus is not used for direct control of the process parameters of the multi-tank dishwasher.

DE 196 08 036 C5 describes how the amount of after-rinse water is directly dependent on the transport speed of the conveyor device of the multi-tank dishwasher. A dependency of the amount of final-rinse water and the heat equivalents actually transmitted to the items to be cleaned is not dealt with in detail according to DE 196 08 036 C5.

SUMMARY OF THE INVENTION

It is therefore an object of the present invention to provide a method for detecting the heat equivalents transmitted to the items to be cleaned, in order to eliminate the above-described disadvantages of the solutions according to the prior art and, at the same time, to improve the processing safety in terms of the thermal hygiene efficiency.

In the solution according to the invention, a method is proposed for assessing and guaranteeing the thermal hygiene efficiency in a multi-tank dishwasher, in which there is at least one sensor that transmits the temperature inside at least one treatment zone to a machine control system, in particular to the control system of the multi-tank dishwasher. This method includes the following method steps: (a) detecting a temperature inside at least one of the treatment zones by means of the sensor; (b) thereafter, determining the heat input applied to the items to be cleaned in at least one of the treatment zones, on the basis of the temperature determined under method step (a); (c) subsequently comparing the heat input in the at least one treatment zone with a predefined heat input; and (d) as a function of the result of the comparison of the heat input values according to method step (c), varying the transport speed of the items to be cleaned through the multi-tank dishwasher, or varying the temperature of at least one process parameter acting on the heat input values as a control variable in a control loop for at least one of the treatment zones.

In method step (c) of the method proposed according to the invention, it can be determined whether the heat input in at least one of the treatment zones corresponds to the predefined heat input, exceeds the predefined heat input or is below the predefined heat input.

As a function of the result of this comparison, and if appropriate as a function of other parameters relevant to the washing result, if the predefined heat input is exceeded, the transport speed of the items to be cleaned can be increased, for example, as control variable for the control loop, so that the items transported through the relevant treatment zone of the multi-tank dishwasher are transported more rapidly through the zone. As an alternative to increasing the transport speed through the relevant treatment zone of the multi-tank dishwasher, it is possible that, if the predefined heat input is exceeded, the temperature in at least one heated zone of the treatment zones is lowered, or the temperature in a downstream treatment zone is lowered, in order to compensate for the increased heat input in the preceding treatment zone. In addition, the temperature can also be lowered in a treatment zone through which the items to be cleaned have already passed, which permits energy savings in terms of the heating of the at least one treatment zone and permits a predictive mode of operation of the multi-tank dishwasher that is highly energy-efficient.

By contrast, if it is found that the actual heat input in at least one of the treatment zones is below the predefined heat input, the machine control system can reduce the transport speed of the items to be cleaned through the at least one relevant treatment zone. On the other hand, if the above criterion is met, i.e. if the actual heat input is below the predefined heat input, it is also possible to stop the passage of the items to be cleaned through the treatment zone of the multi-tank dishwasher and/or to indicate this status on the display of the multi-tank dishwasher, so that the person or persons operating the multi-tank dishwasher are notified and are able to take corresponding measures. Despite the actual heat input being below the predefined heat input in at least one of the treatment zones of the multi-tank dishwasher, it is also possible simply to register this state and not to take any measures, and instead to continuously monitor the heat input into the heated treatment zones of the multi-tank dishwasher. The heat input in the heated treatment zones can also be continuously monitored if it is found that the predefined heat input is exceeded by the actual heat input.

The detection of the temperature in the at least one treatment zone of the multi-tank dishwasher can be done by a sensor which is moved along during the transport of the items to be cleaned through the multi-tank dishwasher and which is mounted, for example, on a basket carrying the items to be cleaned or on a belt or such like continuously conveying the items to be cleaned through the multi-tank dishwasher, and which sensor transmits the temperature values 1 . . . n in the treatment zones to the machine control system. In addition to a sensor which is moved continuously through the multi-tank dishwasher during the transport of the items to be cleaned through the multi-tank dishwasher, the temperature in the individual treatment zones of the multi-tank dishwasher can also be detected by means of sensors assigned in stationary positions to each of said zones and can then be transmitted to the machine control system, in which the actual heat input in the treatment zones is calculated. It is immaterial whether the sensor detecting the individual temperatures in the at least one treatment zone is movable or stationary; the important fact is that the stationary sensor or movable sensor transmits the individual temperatures detected in the at least one treatment zone to the machine control system of the multi-tank dishwasher. In the machine control system, the actual heat input in one or more of the traversed or still to be traversed treatment zones can be calculated as a function of the distance traveled by the items in the respective treatment zone, taking into account the transport speed.

In the machine control system, based on the temperature values determined by the movable or stationary sensor, the actual heat input in the relevant treatment zone can also be calculated as a function of the dwell time of the items in the respective treatment zone.

In the machine control system of the multi-tank dishwasher, the predefined heat inputs in the entire system of the multi-tank dishwasher for guaranteeing hygiene efficiency are stored, for example, either on the basis of heat equivalents HUE of the NSF3 standard or on the basis of the A0 values of EN 158831 Annex 1, or any defined relationship between the temperature and the corresponding heat equivalents. The actual heat input acting on the items in the at least one of the treatment zones of the multi-tank dishwasher is compared with these data stored in the machine control system and with the predefined heat input values resulting therefrom.

In another embodiment of the method proposed according to the invention for assessing and guaranteeing thermal hygiene efficiency in a multktank dishwasher, it is possible, if the actual heat input falls below the predefined heat input, for the transport speed of the items through one of the treatment zones to be temporarily set to 0, i.e. for the transport of the items through the multi-tank dishwasher to be halted. This results in a longer dwell time of the items in at least one of the treatment zones of the multi-tank dishwasher, with the result that the actual heat input increases.

In practical implementation of the method proposed according to the invention, and as a function of the result of the comparison between the actual heat input and the predefined heat input in at least one of or preferably several of the treatment zones of the multi-tank dishwasher, a fresh water flow delivered for example to a fresh-water final-rinse zone can be varied in terms of its volumetric flow, i.e. increased or reduced, or the temperature of the water added in the fresh-water final-rinse zone can be varied, in order to influence the actual heat input. Analogously, in practical implementation of the method proposed according to the invention, the volumetric flow circulated inside a pump-operated final-rinse zone of a multi-tank dishwasher can be increased or reduced. In at least one washing zone of the multi-tank dishwasher upstream of the fresh-water final-rinse zone or pump-operated final-rinse zone, the heating power of the heating elements installed in the tanks of the washing zone can be varied as a function of the result of the comparison between actual heat input and predefined heat input. In the drying zone of the multi-tank dishwasher, which is generally downstream of the fresh-water final-rinse zone or pump-operated final-rinse zone, the actual heat input there can be varied, i.e. increased or reduced, by varying the temperature of the drying air blown onto the items to be washed, i.e. by increasing or lowering its temperature. Moreover, in the method proposed according to the invention, additional heat input into at least one of the treatment zones of the multi-tank dishwasher is possible by means of an infrared emitter which is preferably arranged in or, viewed in the transport direction of the items to be cleaned, downstream of a drying zone. This affords a further possibility of influencing the heat input into the entire system of the multi-tank dishwasher even when the items to be cleaned have already passed through the treatment zones upstream of the drying zone. As an alternative to the additional heat input via an infrared emitter, it is also possible to provide electromagnetic radiation of the items to be washed, or radiation by microwaves or by short or long waves.

Based on the temperature data which are present in the machine control system of the multi-tank dishwasher and which are transmitted to it via the movable or stationary sensor assigned to the at least one treatment zone, the temperature in one of the treatment zones already traversed by the items to be cleaned can be adjusted and/or a prognosis of the heat input can be made on the basis of an extrapolation of the temperature values of a downstream treatment zone viewed in the transport direction of the items to be cleaned. If the sensor for detecting the temperature in the at least one treatment zone is a sensor that is designed to move along with the items to be cleaned, the temperature in a transport zone can be corrected or the temperature in at least one tank assigned to a treatment zone can be corrected as a function of specified rules. If the temperature in at least one of the treatment zones is detected by at least one stationary sensor assigned thereto, the temperature in the at least one treatment zone can be determined, or a temperature gradient present in a heated zone of the treatment zones can be modified.

When the temperature is detected by at least one stationary sensor assigned to at least one treatment zone, the temperature in a treatment zone already traversed by the items to be washed can advantageously be adjusted and/or a prognosis of the heat input can be made on the basis of an extrapolation of the temperature values in downstream treatment zones, viewed in the transport direction of the items to be cleaned.

The method proposed according to the invention has the advantage of ensuring that a multi-tank dishwasher actively monitors the hygiene of the items to be cleaned therein and, for example if irregularities occur in washing operation, for example upon introduction of items for cleaning that have different thermal capacities and upon associated changes in energy requirements, or if cold water is introduced through the machine control system, it initiates suitable measures, such as the abovementioned reduction or increase of the transport speed of a conveyor device. Moreover, in the method proposed according to the invention, satisfactory functioning of the multi-tank dishwasher in terms of thermal hygiene efficiency can be simply demonstrated during operation at the premises of the end-user of the multi-tank dishwasher, without bacterial strains, for example those specified in the context of the aforementioned standards, being actively introduced into the multi-tank dishwasher.

The method proposed according to the invention also permits a guarantee of the hygiene efficiency during operation of the multi-tank dishwasher by the operator.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitive of the present invention, and wherein.

DETAILED DESCRIPTION

Figure 1:
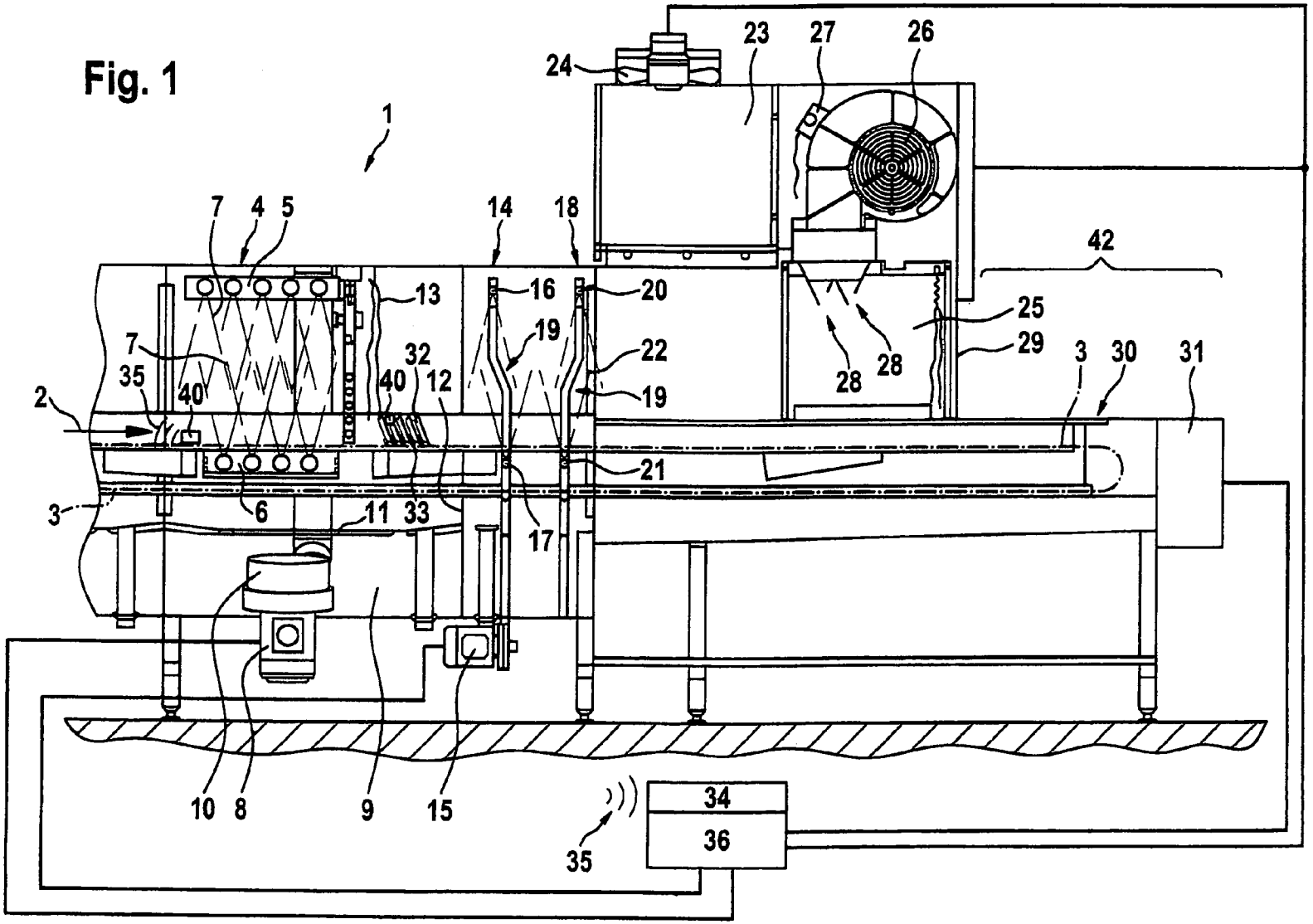
FIG. 1 shows a sectional detail of a conveyor-type dishwasher with a washing zone, a pump-operated final-rinse zone and a fresh-water final-rinse zone.

The view shown in FIG. 1 is of a conveyor-type dishwasher 1 in which items 32 to be cleaned are transported in transport direction 2 through different treatment zones of the conveyor-type dishwasher 1. A conveyor device 3, which is designed as a continuous conveyor belt in the view according to FIG. 1, transports the items 32 to be cleaned through the different treatment zones of the conveyor-type dishwasher 1. Seen in the transport direction 2 of the items 32 to be cleaned, they pass first of all through a washing zone 4.

Inside the washing zone 4, there are a first washing system 5 and a second washing system 6. Cleaning fluid 7 exits from these in the form of jets. The first washing system 5 and the second washing system 6 are supplied with cleaning fluid via a first pump 8. The first pump 8 is accommodated inside a washing zone tank 9 which is assigned to the washing zone 4. A pump housing 10 is located in the upper area of the first pump 8; the washing zone tank 9 is covered by means of a tank cover screen 11. The washing zone tank 9 assigned to the washing zone 4 contains a heated or unheated water supply.

The washing zone 4 is separated by a dividing curtain 13 from the adjacent pump-operated final-rinse zone 14, as seen in the transport direction 2 of the items 32 to be cleaned. The washing zone tank 9 is separated, by a dividing wall 12, from the tank located underneath the pump-operated final-rinse zone 14 and the fresh water final-rinse zone 18.

In the view according to FIG. 1, the items 32 to be cleaned leave the washing zone 4 and pass through the dividing curtain 13 into a pump-operated final-rinse zone 14. The pump-operated final-rinse zone 14 is fed via a second pump 15. The cleaning fluid 7 emerging in the pump-operated final-rinse zone 14 from a first spray pipe 16 and a second spray pipe 17 wets the items 32 from the top and from the bottom. The spray pipes 16 and 17 arranged in the pump-operated final-rinse zone 14 are mounted on a bent pipe, so as to ensure that the first spray pipe 16 is offset relative to the second spray pipe 17 of the pump-operated final-rinse zone 14.

The same applies to a fresh-water final-rinse zone 18 which can be arranged downstream of the pump-operated final-rinse zone 14. The fresh-water final rinse zone 18 comprises an upper spray pipe 20 and a lower spray pipe 21. The two spray pipes 20 and 21 are also offset relative to one another in accordance with the spray pipe course 19, seen in the transport direction 2 of the items to be cleaned. The fresh-water volume emerging from the upper spray pipe 20 and from the lower spray pipe 21 wets the items 32 from the top and from the bottom.

The fresh-water final-rinse zone 18 is followed by a heat recovery device 23 which contains an exhaust fan 24 with which exhaust air is withdrawn from the conveyor-type dishwasher 1. Viewed in the transport direction 2 of the items 32 to be cleaned, the heat recovery device 23 is followed by a drying zone 25. The drying zone 25 comprises a fan 26 to which a sensor 27 is assigned.

The air emerging from the fan 26 is blown through outlet nozzles 28 onto the top of the items to be cleaned. In the view according to FIG. 1, the fan 26 is assigned two outlet nozzles 28 which are arranged one after the other as seen in the transport direction 2 of the items 32 to be cleaned. The drying zone 25 is screened off, by means of a further dividing curtain 33, from a removal area 30 of the conveyor-type dishwasher 1. In the removal area 30 of the conveyor-type dishwasher 1 according to the view in FIG. 1, the dried and partially cooled items 32 that have now been cleaned can be removed from the conveyor device 3 designed as conveyor belt. The conveyor device 3 designed as conveyor belt is driven via a drive mechanism 31 which can be arranged at the end of the removal area 30. It will also be seen from the view according to FIG. 1 that cableless sensors 40 can be mounted on individual retaining devices 33 of the conveyor device 3. The position of assembly of the cableless sensor 40 in the upper area of retaining devices 33 for items 32 to be cleaned ensures that the temperature value which is detected by the sensor 40, and which is fed via a signal 35 to a receiver part 34 of the control system 36, corresponds to the temperature of the items 32 to be cleaned in the conveyor device 3. Alternatively, the cableless sensor 40 for detecting and transmitting the temperature signal 35 can also be mounted on a transport element of the conveyor device 3 preferably designed as conveyor belt. According to the design variant shown in FIG. 1, the conveyor device 3 transports the cableless sensor 40, together with the items 32 to be cleaned, through the individual treatment zones 4, 14, 18 and 25 of the conveyor-type dishwasher 1. The temperatures thereby detected can either be transmitted permanently to the control system 36 at the end of each individual treatment zone 4, 14, 18, 25 or at the end of the whole process. From these signals, the control system 36 calculates the heat equivalents transmitted to the items 32 to be cleaned during the washing process and, if necessary, corrects the transport speed of the conveyor device 3 in transport direction 2, the temperature of the final-rinse water applied to the items 32 in the pump-operated final-rinse zone 14 and in the fresh-water final-rinse zone 18, or other process parameters.

Figure 2:
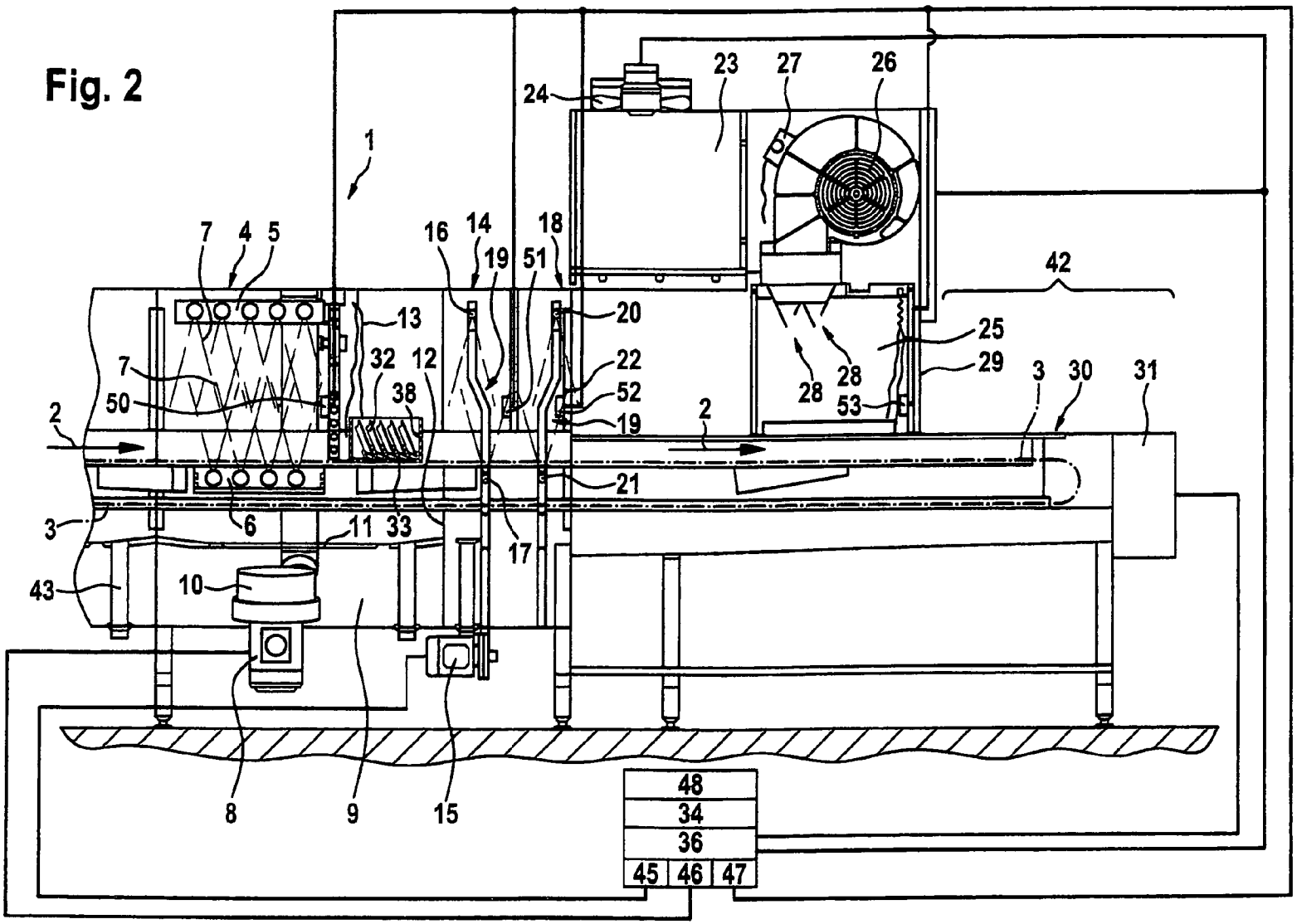
FIG. 2 shows sensors which are assigned to the individual treatment zones and which are installed in stationary positions.

FIG. 2 shows a conveyor-type dishwasher with stationary sensors each assigned to the individual treatment zones.

By means of the method proposed according to the invention and by means of the correspondingly designed conveyor-type dishwasher 1, it is possible, with continuous transport of the items 32 to be cleaned through the conveyor-type dishwasher 1, to achieve at all times an optimal transport speed of the conveyor device 3 in the individual treatment zones 4, 14, 18, 25, as a function of the process steps taking place therein.

In the different treatment zones 4, 14, 18, 25 of the conveyor-type dishwasher 1, there are preferably stationary sensors 50, 51, 52, 53 that are arranged in the different treatment zones. The respective installation positions of the sensors 50, 51, 52, 53 are shown by way of example. Depending on the other boundary conditions, the positions of the respective sensors 50, 51, 52, 53 are chosen such that the temperatures determined by them correspond to the temperatures of the items 32 as they pass through the different treatment zones 4, 14, 18, 25 within the conveyor-type dishwasher 1. The sensors 50, 51, 52, 53 exchange measurement data with the control system 36 of the conveyor-type dishwasher 1. The control system 36 assigned to the conveyor-type dishwasher 1 can either be an internal control system, i.e. arranged inside the conveyor-type dishwasher 1, or an external control system 36, i.e. arranged outside the conveyor-type dishwasher 1. The control system 36 comprises a microprocessor (CPU) 45 and a data memory 46. Via a main control line, all the functions are controlled in respect of the program steps taking place in the conveyor-type dishwasher 1, i.e. also the method carried out inside the conveyor-type dishwasher 1 for assessing the hygiene efficiency. The control system 36 additionally comprises a unit 47 which records measured data and via which the temperature values detected by the at least one stationary sensor 50, 51, 52, 53 can be recorded and stored in a data memory 46. The stationary sensors 50, 51, 52, 53 are connected to the control system 36 via the lines shown in FIG. 2, via which the individual process steps of the conveyor-type dishwasher 1 are controlled.

Moreover, the control system 36 controls the electrical power supply to the pumps 8 and 15 via an output regulator that can be coupled to said pumps. The fresh water pump, i.e. the second pump 15, can also be assigned an output regulator via which the electrical power supply to the freshwater pump can be controlled. The same applies to and output regulator via which the power supply to a heating element for the detergent can be controlled, and also to a further output regulator which controls the power supply to a heating element in an optionally provided heater or boiler for heating the final-rinse water.

The data memory 46 provided in the control system 36 stores the values for the heat equivalents which are set either according to the NSF3 standard or according to the A0 method for determining and classifying the hygiene efficiency of a conveyor-type dishwasher 1. The data memory 46 of the control system 36 can, for example, store the following A0 values according to the prEN ISO 15883 expected in Europe:

| | | | $A_0$3000 | |
|---|---|---|---|---|
| Temperature | $A_0$60(sec) | $A_0$600(sec) | (sec) = | (min) |
| 65° | 1,897.4 | 18,973.7 | 94,863.3 | 1,581.1 |
| 66° | 1,507.1 | 15,071.3 | 75,356.6 | 1,255.9 |
| 67° | 1,197.2 | 11,971.6 | 59,857.9 | 997.6 |
| 68° | 950.9 | 9,509.4 | 47,546.8 | 792.4 |
| 69° | 755.4 | 7,553.6 | 37,767.8 | 629.5 |
| 70° | 600.0 | 6,000.0 | 30,000.0 | 500.0 |
| 71° | 476.6 | 4,766.0 | 23,829.8 | 397.2 |
| 72° | 378.6 | 3,785.7 | 18,928.7 | 315.5 |
| 73° | 300.7 | 3,007.1 | 15,035.6 | 250.6 |
| 74° | 238.9 | 2,388.6 | 11,943.2 | 199.1 |
| 75° | 189.7 | 1,897.4 | 9,486.8 | 158.1 |
| 76° | 150.7 | 1,507.1 | 7,535.7 | 125.6 |
| 77° | 119.7 | 1,197.2 | 5,985.8 | 99.8 |
| 78° | 95.1 | 950.9 | 4,754.7 | 79.2 |
| 79° | 75.5 | 755.4 | 3,776.8 | 62.9 |
| 80° | 60.0 | 600.0 | 3,000.0 | 50.0 |
| 81° | 47.7 | 476.6 | 2,383.0 | 39.7 |
| 82° | 37.9 | 378.6 | 1,892.9 | 31.5 |
| 83° | 30.1 | 300.7 | 1,503.6 | 25.1 |
| 84° | 23.9 | 238.9 | 1,194.3 | 19.9 |
| 85° | 19.0 | 189.7 | 948.7 | 15.8 |
| 86° | 15.1 | 150.7 | 753.6 | 12.6 |
| 87° | 12.0 | 119.7 | 598.6 | 10.0 |
| 88° | 9.5 | 95.1 | 475.5 | 7.9 |
| 89° | 7.6 | 75.5 | 377.7 | 6.3 |
| 90° | 6.0 | 60.0 | 300.0 | 5.0 |
| 91° | 4.8 | 47.7 | 238.3 | 4.0 |
| 92° | 3.8 | 37.9 | 189.3 | 3.2 |
| 93° | 3.0 | 30.1 | 150.4 | 2.5 |
| 94° | 2.4 | 23.9 | 119.4 | 2.0 |
| 95° | 1.9 | 19.0 | 94.9 | 1.6 |

The A0 value that can be taken from the above table is defined as the time equivalent in seconds at which a disinfection action is exerted. The A0 value of a disinfection process with moist heat characterizes the killing of germs, given as the time equivalent in seconds at a temperature transmitted by the process to the product, for example to the items 32 to be cleaned.

A stationary sensor 50, 51, 52, 53 installed in a respective treatment zone 4, 14, 18, 25 of a conveyor-type dishwasher 1 can be likened to the temperature sensor used in the NSF3 standard test method or the temperature sensor used in the A0 test method, since the same heat equivalents as in the NSF3 standard method and the A0 test method can be determined by the control system 36 in the conveyor-type dishwasher 1. Via the control system 36 and via the sensors 40; 50, 51, 52, 53 arranged inside the respective treatment zones 4, 14, 18, 25 or on the conveyor device passing through these, the heat equivalents reached within a program step are instantly determined and are compared with the table values stored in the data memory 46, for example with the values stored for prEN ISO 15883-1. If the values for the heat equivalents which are detected by the sensors 40; 50, 51, 52, 53 and are reached inside the respective treatment zone 4, 14, 18, 25 of the conveyor-type dishwasher 1 are too low, the temperature of the detergent stored in the detergent tank can be increased via the control system 36, or the temperature of the fresh water delivered via the final-rinse systems 20, 21 inside the final-rinse zone 18 can be increased via the control system 36. To do this, the control system 36 acts on the corresponding output regulators assigned to the respective pumps 8, 15. Moreover, as a function of the heat equivalent values calculated in the control system 36, it is also possible for the control system 36 to vary the transport speed of the items 32 to be cleaned in the transport direction 2 through the conveyor-type dishwasher 1. If the values required for the heat equivalents in accordance with the stated standards are not reached, it is possible, for example, for the control system 36 to act on the drive mechanism of the conveyor device 3 in such a way that the latter runs more slowly and the items 32 to be cleaned are thus transported at a lower speed through the individual treatment zones of the conveyor-type dishwasher 1, so that the period of action of the heat equivalents is lengthened, which in the final analysis contributes to guaranteeing or increasing the temperature acting on the items 32 that are to be cleaned or that have been cleaned.

If the values defined by the NFS3 standard or by prEN ISO 15883-1 for the heat equivalents input to the respective treatment zones 4, 14, 18, 25 of the conveyor-type dishwasher 1 are reached, the items 32 to be cleaned are transported into the next one of the treatment zones 4, 14, 18, 25. The determined values for the heat equivalents can be shown on a display 48.

A further advantage that can be achieved by the method proposed according to the invention, and implemented on a conveyor-type dishwasher 1 for assessing and guaranteeing hygiene efficiency, is that the conveyor-type dishwasher 1 actively monitors the hygiene of the items 32 to be cleaned. Irregularities in the washing operation, as may occur for instance if a large amount of cold water is introduced into the detergent tank, for example, and causes the temperature to drop in the washing zone 4, can be compensated for by suitable countermeasures initiated via the control system 36. Thus, for example, the after-rinse operation can be lengthened via the control system 36, or corresponding control of an output regulator assigned to the heating element of the detergent tank can increase the temperature thereof, in order to counteract the drop in temperature caused by the influx of cold water. As has already been discussed above, it is also possible for the transport speed of the conveyor belt through the individual treatment zones 4, 14, 18, 25 of the conveyor-type dishwasher 1 to be varied using the values determined by the control system 36 for the heat equivalents that are based on the temperatures detected by the cableless sensors 40 or by the stationary sensors 50, 51, 52, 53. By means of the method proposed according to the invention, it is possible, in each process step inside the conveyor-type dishwasher 1, and independently of any irregularities, to determine before the start of each process step the heat equivalents that have been reached and then to assess them according to the specifications of NSF3 or prEN ISO 15883-1, and to control the process parameters of the conveyor-type dishwasher 1 accordingly. The values obtained for the calculated heat equivalents can be shown on the display 48. The person using the conveyor-type dishwasher 1 is thus afforded the possibility of monitoring and controlling the thermal hygiene efficiency during each process step.

The method proposed according to the invention can preferably be implemented on the multi-tank dishwashers which are shown in FIGS. 1 and 2 and designed as conveyor-type dishwasher and which comprise at least one cleaning zone, one pump-operated final-rinse zone, one fresh-water final-rinse zone and, if appropriate, a drying zone.

The conveyor-type dishwasher 1 explained above in connection with FIGS. 1 and 2 comprises a machine control system that comprises at least a microprocessor 45, a data memory 46, a device 47 for recording measured data, and a display 48. Via the sensors 27 and also 40, 50, 51, 52, 53, the temperatures inside the at least one treatment zone 4, 14, 18, 25 are transmitted to the machine control system 36. Beforehand, the temperatures inside at least one of the treatment zones 4, 14, 18, are detected by the sensors 40, 50, 51 and 53, and the machine control system 36 determines the heat input applied to the items 32 to be cleaned in at least one of the treatment zones 4, 14, 18, 25 on the basis of the previously determined temperature. The machine control system 36 then compares the heat input in the at least one treatment zone 4, 14, 18, 25 with a predefined heat input. As a function of the result of this comparison of the heat input values, either the transport speed of the items 32 through the conveyor-type dishwasher 1 is varied, or the temperature of at least one of the process parameters influencing the heat input values as a control variable is varied in a control loop for at least one of the treatment zones 4, 14, 18, 25.

As a function of the result of the comparison on whether the heat input into at least one of the treatment zones 4, 14, 18, 25 corresponds to the predefined heat input value, it is found that the predefined heat input is exceeded, is not attained, or is met exactly.

If the predefined heat input is exceeded, the transport speed of the items 32 to be washed can be increased or the temperature in the affected treatment zone 4, 14, 18, 25 can be lowered. If this concerns a heated treatment zone 4, 14, 18, 25, then, in the case of a cleaning zone, for example, a heating element installed in a tank can have its heat output reduced, or the temperature in a subsequent treatment zone, as seen in the delivery direction of the items 32 to be washed through the treatment zones 4, 14, 18, 25, can be lowered. It is also possible to lower the temperature in one of the treatment zones 4, 14, 18, 25 already traversed by the items 32 to be washed, in order to optimize the heating performance of the entire system of the conveyor-type dishwasher 1.

If the comparison carried out in the machine control system 36 establishes that the predefined heat input is not attained by the actual heat input applied to the items 32 to be washed, the machine control system 36 can reduce the transport speed of the items 32 through at least one of the treatment zones 4, 14, 18, 25. To achieve this, the speed of rotation of the drive mechanism driving the conveyor device 3 can be reduced. Moreover, the machine control system 36 can also stop the transport of the items 32 through the treatment zones 4, 14, 18, 25 in the conveyor device 3 and, after a dwell time has elapsed, can restart the transport. As an alternative to interrupting the passage of the items 32 through the treatment zones 4, 14, 18, 25 of the conveyor-type dishwasher 1, this circumstance can also just be indicated on the display 48 of the machine control system 36. If the predefined heat input is exceeded by the actual heat input acting on the items 32 to be washed in at least one of the treatment zones 4, 14, 18, 25, again this state of affairs can just be indicated on the display 48, in which case it is up to the person or persons operating the conveyor-type dishwasher 1 to act on the machine control system 36 and instigate counter-measures.

Whereas the sensor 40 in the conveyor-type dishwasher 1 according to FIG. 1 is transported along with the items 32 to be cleaned in the conveyor direction 3 through the conveyor-type dishwasher 1, the sensor 27 assigned to the drying zone 25 is installed in a stationary position. The same also applies to the design variant of the conveyor-type dishwasher 1 shown in FIG. 2, where the sensors 50, 51, 52 and 53 are assigned in stationary positions to the respective treatment zones. During the transport of the items 32 to be cleaned in delivery direction 3 through the conveyor-type dishwasher 1, the sensor 40 moved along with them in accordance with FIG. 1 can detect the temperature values 1 . . . n in the respective treatment zones 4, 14, 18, 25, and, after they have been transmitted to the machine control system 36, the actual heat input in the respective treatment zones 4, 14, 18, 25 can be calculated. In the illustrative embodiment shown in FIG. 2 with stationary sensors 50, 51, 52 and 53, the heat input into the treatment zones 4, 14, 18, 25 is calculated by taking into account the distance the items 32 have traveled in the delivery direction 3 in the respective treatment zone and taking into account the actual speed of the conveyor device 3. The heat input into the at least one of the treatment zones 4, 14, 18, 25 can also be determined as a function of the dwell time of the items 32 in the respective treatment zone 4, 14, 18, 25, for example by adjusting the restart time after stoppage of the transport of the items 32 in transport direction 2 through the conveyor-type dishwasher 1.

In the machine control system 36, the predefined heat input values are stored either on the basis of the heat equivalents (HUE) of the NSF3 standard or the A0 values of EN 15883-1 Annex 1 or any other defined relationship between the temperature and the corresponding heat equivalents.

As has already been explained above, if the actual heat input into at least one of the treatment zones is below the predefined heat input, the transport speed of the items 32 to be cleaned in transport direction 2 through one of the treatment zones 4, 14, 18, 25 can temporarily be set to 0. For practical variation of the heat input, the fresh water stream delivered to the fresh-water final-rinse zone 18 can be varied in terms of volumetric flow or in terms of the temperature of the fresh water 22 to be delivered to the fresh-water final-rinse zone 18. In the pump-operated final-rinse zone 14 also, the volumetric flow circulated there can be increased or decreased in order to vary the temperature. In one or several of the washing zones 4 of the conveyor-type dishwasher 1, heating elements arranged in tanks 9 can be varied in terms of their heating power in order to vary the actual heat input values in the washing zones 4. Inside the drying zone 25, the temperature of the air used to dry the items 32 to be cleaned can be modified as a function of the comparison between the predefined heat input and the actual heat input.

In another advantageous embodiment of the method proposed according to the invention, the conveyor-type dishwasher 1 shown in FIGS. 1 and 2 can be provided, downstream of the drying zone 25, with an infrared emitter, an electromagnetic radiation emitter, or a microwave unit, or a short-wave or long-wave emitter, in order to create an additional possibility whereby, after all the treatment zones 4, 14, 18, 25 have been traversed, the items 32 which are to be cleaned and which have already passed through the aforementioned treatment zones are treated further in terms of the heat input acting on the items 32.

If the sensor is a sensor 40 that is moved, then this, in combination with the machine control system 36, can adapt the temperature in one of the treatment zones 4, 14, 18, 25 already traversed by the items 32 to be cleaned and/or a prognosis of the heat input can be made on the basis of an extrapolation of the temperature values of a downstream treatment zone 4, 14, 18, 25 as seen in the transport direction of the items 32 to be cleaned, which in energy terms thus permits an optimized operation of the conveyor-type dishwasher 1.

In the case where the temperature is detected by means of a sensor 40 moved through the treatment zones 4, 14, 18, 25, the temperature in a transport zone can be corrected, or the temperature in at least one tank 9 assigned to a treatment zone can be corrected.

By contrast, if the sensors 50, 51, 52, 53 are assigned in stationary positions to the treatment zones 4, 14, 18, 25, as shown in FIG. 2, they determine the temperature directly in the treatment zone, or a temperature gradient in a heatable zone of the treatment zones 4, 14, 18, 25 can be altered. In the case of stationary sensors 40, 50, 51, 52, 53, the temperature in a treatment zone 4, 14, 18, 25 already traversed by the items 32 to be cleaned can be adapted, and a prognosis of the heat input can be made on the basis of an extrapolation of the temperature values in subsequent treatment zones 4, 14, 18, 25 as seen in the transport direction 2 of the items 32 to be cleaned.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. A method for assessing and guaranteeing a thermal hygiene efficiency in a multi-tank dishwasher having at least one sensor that transmits a temperature inside at least one treatment zone to a machine control system or to a control system of the multi-tank dishwasher, the method comprising:

detecting the temperature inside at least one of the treatment zones via the sensor;

determining a heat input applied to items that are to be cleaned in at least one of the treatment zones based on the detected temperature;

subsequently comparing the heat input in the at least one treatment zone with a predefined heat input; and varying, as a function of the result of the comparison of the heat input values, a transport speed of the items to be cleaned through the multi-tank dishwasher or varying the temperature of at least one process parameter acting on the heat input values as a control variable in a control loop for at least one of the treatment zones, the temperature being detected by a sensor either moved through the treatment zones or being stationarily mounted in a treatment zone of the multi-tank dishwasher, the temperature in one of the treatment zones already traversed by the items to be cleaned being adjusted and/or a prognosis of the heat input being made on the basis of an extrapolation of the temperature values of a downstream treatment zone viewed in the transport direction of the items to be cleaned.

2. The method according to claim 1, wherein in the comparison step, it is determined whether the heat input in the at least one treatment zone that corresponds to a predefined heat input exceeds the predefined heat input or is below the predefined heat input.

3. The method according to claim 2, wherein, if the predefined heat input is exceeded, the transport speed of the items to be cleaned is increased as a control variable.

4. The method according to claim 2, wherein, if the predefined heat input is exceeded, the temperature in at least one heated zone of the treatment zones is lowered.

5. The method according to claim 4, wherein the temperature in a downstream treatment zone is lowered.

6. The method according to claim 4, wherein the temperature is lowered in a treatment zone of the treatment zones through which the items to be cleaned have already passed.

7. The method according to claim 2, wherein, if the heat input is below the predefined heat input, the transport speed of the items to be cleaned through at least one of the treatment zones is reduced.

8. The method according to claim 2, wherein, when a discontinue criterion is satisfied, the passage of the items to be cleaned through the treatment zones of the multi-tank dishwasher is stopped and/or this status is displayed.

9. The method according to claim 2, wherein, if the heat input is below the predefined heat input, no measures are taken, and instead the heat input in the heated treatment zones is continuously monitored.

10. The method according to claim 2, wherein, if the predefined heat input is exceeded, no measures are taken, and instead the heat input in the heated treatment zones is continuously monitored.

11. The method according to claim 1, wherein the at least one sensor detecting the temperature in at least one treatment zone is moved along during the transport of the items to be cleaned through the multi-tank dishwasher, and the heat input is determined from the detected temperature values.

12. The method according to claim 1, wherein the temperature of the treatment zones is in each case detected by respective stationary sensors, and the heat input in the treatment zones is calculated as a function of the distance traveled by the items to be cleaned in the zone and as a function of the conveyor belt speed.

13. The method according to claim 12, wherein the heat input in at least one of the treatment zones is calculated as a function of the dwell time of the items to be cleaned in the respective treatment zone.

14. The method according to claim 1, wherein the predefined heat input values correspond either to the heat equivalents of the NSF3 standard or to the A0 values of EN 15883-1 Annex A, or any defined relationship between the temperature and the corresponding heat equivalents.

15. The method according to claim 2, wherein, if the actual heat input is below the predefined heat input, the transport speed of the items to be washed through one of the treatment zones is temporarily set to 0.

16. A method for assessing and guaranteeing a thermal hygiene efficiency in a multi-tank dishwasher having at least one sensor that transmits a temperature inside at least one treatment zone to a machine control system or to a control system of the multi-tank dishwasher, the method comprising:

detecting the temperature inside at least one of the treatment zones via the sensor;

determining a heat input applied to items that are to be cleaned in at least one of the treatment zones based on the detected temperature;

subsequently comparing the heat input in the at least one treatment zone with a predefined heat input; and varying, as a function of the result of the comparison of the heat input values, a transport speed of the items to be cleaned through the multi-tank dishwasher or varying at least one process parameter acting on the heat input values as a control variable in a control loop for at least one of the treatment zones, wherein, as a function of the result of the comparison step, a fresh water flow delivered in a fresh-water final-rinse zone is varied in terms of its volumetric flow, or the temperature of the water added in the fresh-water final-rinse zone is varied.

17. The method according to claim 1, wherein, as a function of the result according to the comparison step, a volumetric flow circulated inside a pump-operated final-rinse zone is increased or reduced.

18. The method according to claim 1, wherein, as a function of the result of the comparison step, a heating power of heating elements installed in a washing zone of the multi-tank dishwasher is varied.

19. The method according to claim 1, wherein, as a function of the result of the comparison step, the temperature of the air located inside a drying zone of the treatment zones is varied.

20. The method according to claim 1, wherein, as a function of the result of the comparison step, additional heat is input into the treatment zones by an infrared emitter, which, viewed in the transport direction of the items to be cleaned, is arranged downstream of a drying zone.

21. The method according to claim 1, wherein, as a function of the result of the comparison step, additional heat is input into at least one treatment zone by electromagnetic radiation or by microwaves or by short or long waves.

22. The method according to claim 1, wherein, when the temperature is detected by a sensor moved through the treatment zones, the temperature in a transport zone is corrected or the temperature in at least one tank assigned to a treatment zone is corrected as a function of specified rules.

23. The method according to claim 1, wherein, when the temperature is detected by at least one stationary sensor assigned to a treatment zone, the temperature in the at least one treatment zone is determined, or a temperature gradient present in a heated zone of the treatment zones is modified.

24. The method according to claim 1, wherein, when the temperature is detected by at least one stationary sensor, the temperature in a treatment zone already traversed by the items to be washed is adjusted and/or a prognosis of the heat input is made on the basis of an extrapolation the temperature values in a downstream treatment zone viewed in the transport direction of the items to be cleaned.

25. A method for assessing and guaranteeing a thermal hygiene efficiency in a multi-tank dishwasher having at least one sensor that transmits a temperature inside at least one treatment zone to a machine control system or to a control system of the multi-tank dishwasher, the method comprising:

detecting the temperature inside at least one of the treatment zones via the sensor;

determining a heat input applied to items that are to be cleaned in at least one of the treatment zones based on the detected temperature;

subsequently comparing the heat input in the at least one treatment zone with a predefined heat input; and varying, as a function of the result of the comparison of the heat input values, a transport speed of the items to be cleaned through the multi-tank dishwasher as a control variable in a control loop for at least one of the treatment zones.

* * * * *